United States Patent [19]

White et al.

[11] 4,387,319

[45] Jun. 7, 1983

[54] METAL HALIDE LAMP CONTAINING $ScI_3$ WITH ADDED CADMIUM OR ZINC

[75] Inventors: Philip J. White, Hyde Park, Mass.; William H. Lake, Novelty; Robert H. Springer, Solon, both of Ohio

[73] Assignee: General Electric Company, Schenectady, N.Y.

[21] Appl. No.: 248,968

[22] Filed: Mar. 30, 1981

[51] Int. Cl.[3] ..... H01J 61/20; H01J 61/22; H01J 61/30

[52] U.S. Cl. ..... 313/620; 313/634; 313/642

[58] Field of Search ..... 313/229, 220

[56] References Cited

U.S. PATENT DOCUMENTS

| | | | |
|---|---|---|---|
| 3,398,312 | 8/1968 | Edris et al. | 313/225 |
| 3,959,682 | 5/1976 | Wesselink et al. | 313/229 X |
| 4,161,672 | 7/1979 | Cap et al. | 313/220 |
| 4,171,498 | 10/1979 | Fromm et al. | 313/229 |
| 4,199,701 | 4/1980 | Bhattacharya | 313/229 |
| 4,245,175 | 1/1981 | McAllister | 313/229 |

*Primary Examiner*—Palmer C. Demeo

*Attorney, Agent, or Firm*—John P. McMahon; Philip L. Schlamp; Fred Jacob

[57] ABSTRACT

A high intensity metal halide discharge lamp has a fill comprising mercury, sodium iodide and scandium triiodide plus an inert starting gas. Cadmium or zinc may be added in a molar ratio relative to $ScI_3$ within the range of 0.04 to 1.0 to achieve a lowering in color temperature of several hundred degrees Kelvin at the cost of a minor decrease in lumens which is offset by an improvement in maintenance.

4 Claims, 4 Drawing Figures

METAL HALIDE LAMP CONTAINING $ScI_3$ WITH ADDED CADMIUM OR ZINC

The invention relates generally to high intensity discharge lamps of the metal halide type in which the fill comprises mercury and light-emitting metal halides, and more particularly to miniature lamps of this kind containing mercury and sodium and scandium iodides and having a short arc gap.

BACKGROUND OF THE INVENTION

Metal halide lamps began with the addition of the halides of various light-emitting metals to the high pressure mercury vapor lamp in order to modify its color and raise its operating efficacy as proposed by U.S. Pat. No. 3,234,421 - Reiling, issued in 1966. Since then metal halide lamps have been widely used for general illumination of commercial and industrial places and in outdoor lighting. Their construction and mode of operation are described at pages 8–34 of IES Lighting Handbook, 5th Edition, 1972, published by the Illuminating Engineering Society.

The metal halide lamp generally operates with a substantially fully vaporized charge of mercury and an unvaporized excess consisting mostly of metal iodides in liquid form. One filling which has been favored comprises the iodides of sodium, scandium and thorium. The operating conditions together with the geometrical design of the lamp envelope must provide sufficiently high temperatures, particularly in the ends, to vaporize a substantial quantity of the iodides, especially of the NaI. In general, this requires minimum temperatures under operating conditions of the order of 700° C.

In U.S. Pat. No. 4,161,672 - Cap et al, July 1979, miniature metal halide arc tubes are disclosed which utilize thin-walled fused silica envelopes with small end seals and achieve high efficacy in discharge volumes of 1 cubic centimeter or less. Those miniature arc tubes are particularly useful as the principal light source in lighting units designed for functional similarity to common incandescent lamps. For such applications a low color temperature matching that of the incandescent lamp which has a color temperature of about 2900 K. is particularly desirable. The color temperature of current metal halide lamps containing a dose of $NaI/ScI_3/ThI_4$ is typically around 4200 K. or above for a clear lamp. By applying a phosphor favoring the low side of the spectrum to the outer envelope, the effective color temperature may be lowered to 3800 K. but this reduces efficiency and still falls short of the objective.

It is possible to lower the color temperature of NaI-containing lamps by increasing the relative sodium concentration in the arc. This may be achieved by changing physical construction parameters such as arc tube size, length to diameter ratios, and electrode lengths. The effect of the physical construction changes must be to increase the temperature of the halide pool thereby increasing the sodium pressure to yield a lower color temperature lamp. As a consequence of the reactive nature of the metal halides used, increasing the average wall temperature increases the rate of deleterious chemical reaction processes which can result in poor maintenance and short life. These unwanted effects are aggravated by small envelope volume in miniature lamps.

Another mechanism which may be used for lowering color temperature in NaI-containing lamps is a mercury density in the discharge space high enough to broaden the sodium D line (589 nm) into the red region. By using this mechanism with miniature metal halide lamps we have achieved color temperatures as low as 3500 K. but this is still short of the 2900 K. objective.

In the copending application of John E. Spencer and Ashok K. Bhattacharya, Ser. No. 93,899, filed Nov. 13, 1979, Metal Halide Lamp Containing $ThI_4$ With Added Elemental Cadmium or Zinc and now U.S. Pat. No. 4,360,756, improved maintenance is sought in a lamp using a thorium-tungsten cathode. Such an electrode is formed by operating a tungsten cathode, generally a tungsten rod having a tungsten wire coiled around it in a thorium iodide-containing atmosphere. Under proper conditions the rod acquires a thorium spot on its distal end from the $ThI_4$ dosed into the lamp. This thorium then serves as a good electron emitter which is continually renewed by a transport cycle involving the halogen present which returns to the cathode any thorium lost by any process. The thorium-tungsten cathode and its method of operation are described in Electric Discharge Lamps by John F. Waymouth, M.I.T. Press, 1971, Chapter 9. Spencer and Bhattacharya found that the proper operation of the thorium transport cycle is suppressed when excess or free iodine is present in the lamp atmosphere during operation. They teach as remedy adding a getter in the form of a metal whose free energy of formation as an iodide compound must be more negative than that of $HgI_2$ but less negative than that of the $ThI_4$. They propose as getters the metals Cd, Zn, Cu, Ag, In, Pb, Cd, Zn, Mn, Sn and Tl.

SUMMARY OF THE INVENTION

We have found that in miniature metal halide lamps, that is lamps of envelope volume less than 1 cubic centimeter and having an arc gap less than 1 centimeter in length, the addition of cadmium or zinc as a getter as proposed by Spencer and Bhattacharya, so enhances the thorium transport cycle that the cathode becomes deformed and the arc gap length changes. In a short arc gap high voltage gradient lamp, this entails a relatively large change in the arc voltage drop which cannot be tolerated. Our invention resolves this problem by eliminating thorium iodide from the lamp.

We have found further that the addition of metallic cadmium or zinc to miniature arc tubes containing NaI and $ScI_3$ together with sufficient Hg to broaden the sodium D line into the red region will lower the color temperature to the desired 2900 K. This is achieved without attendant changes in physical construction or increases in wall temperature. Alternatively, the additive may be used to maintain a desired color temperature at reduced wall temperature. The Cd or Zn should be added in a molar ratio of 0.04 to 1.0 relative to the $ScI_3$. We have determined that the addition of cadmium or zinc to the metal halide dose contributes only slightly by direct cadmium or zinc radiation to the visible radiation, but acts to modify the balance between sodium and scandium radiation in the visible spectral region by reducing the amount of $ScI_3$ available to the arc, thereby increasing the effective ratio of NaI to $ScI_3$. A close examination of the vapor pressures of the metals proposed by Spencer and Bhattacharya shows that those of Cd and Zn are high enough at 1100 K. to be important in gas phase reactions as metals and give useful color temperature reduction by this mechanism.

DETAILED DESCRIPTION

Figure 1:
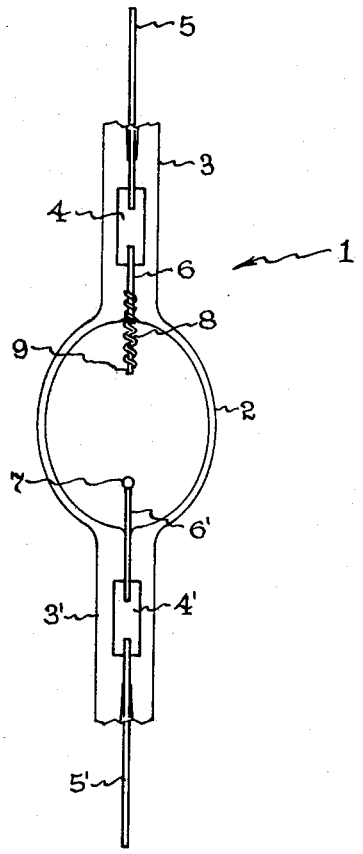
FIG. 1 shows to an enlarged scale a miniature metal halide arc tube in which the invention may be embodied.

The arc tube 1 of a high pressure metal halide lamp in which the invention may be embodied is shown in FIG. 1 and corresponds in kind to the new miniature metal halide lamps disclosed in U.S. Pat. No. 4,161,672 - Cap and Lake. Such arc tube is normally enclosed in an outer envelope or jacket shielding it from the atmosphere. It is made of quartz or fused silica and comprises a central ellipsoidal bulb portion 2 which may be formed by the expansion of quartz tubing, and neck portions 3,3' formed by collapsing or vacuum sealing the tubing upon molybdenum foil portions 4,4' of electrode inlead assemblies. The discharge chamber or bulb is less than 1 cc in volume; for a 32 watt arc tube having a minor internal diameter of about 0.65 cm, the volume may be from 0.11 to 0.19 cc. Leads 5,5' welded to the foils project externally of the necks while electrode shanks 6,6' welded to the opposite sides of the foils extend through the necks into the bulb portion. The illustrated lamp is intended for unidirectional current operation and the shank 6' terminated by a balled end 7 suffices for an anode. The cathode comprises a hollow tungsten helix 8 spudded on the end of shank 6 and terminating at its distal end in a short pin-like insert 9. The invention is equally useful in a.c. operated lamps.

A suitable filling for the envelope comprises argon or other inert gas at a pressure ranging from several torr to a few hundred torr to serve as starting gas, and a charge comprising mercury and the metal halides NaI and $ScI_3$. We have experimented with NaI concentrations ranging from 0.005 gm/cc to 0.05 gm/cc and $ScI_3$ concentrations ranging from 0.0008 gm/cc to 0.008 gm/cc and found that the addition of cadmium lowers the effective color temperature throughout these ranges. In order to take advantage of the color temperature lowering effect of sodium line broadening, a mercury concentration from 0.015 to 0.05 gm/cc should be used. A typical charge in a 32 watt arc tube having a volume of approximately 0.15 cc comprises 5.0 mg Hg, 0.52 mg $ScI_3$, 3.48 mg NaI; the corresponding concentrations in gm/cc are 0.033 for Hg, 0.0035 for $ScI_3$, and 0.023 for NaI. The fill pressure of argon is approximately 120 torr.

Figure 2:
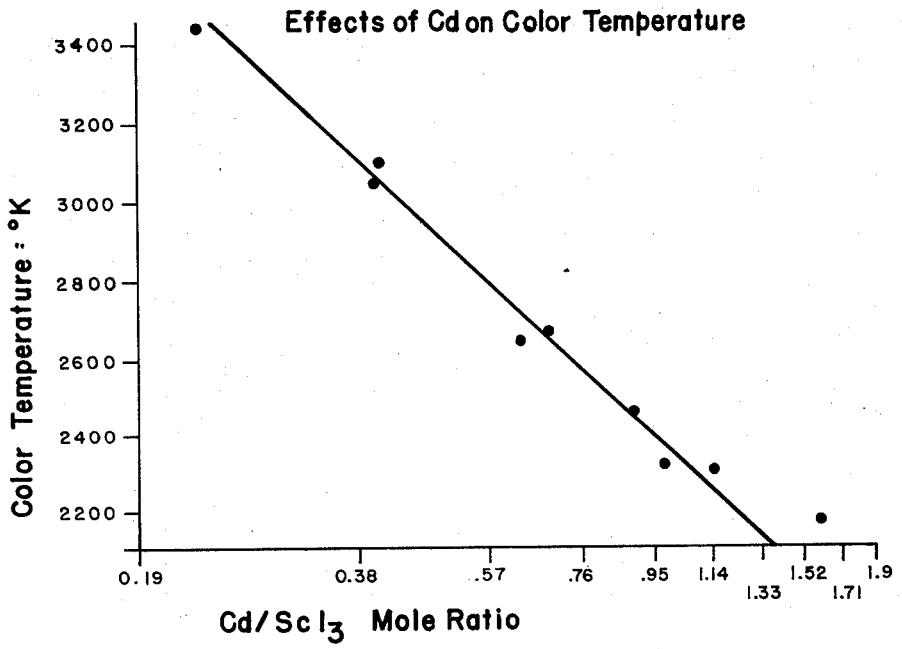
FIG. 2 is a graph showing the effect of cadmium addition on color temperature.

The extent to which the addition of metallic cadmium in accordance with our invention to arc tubes containing NaI and $ScI_3$ will lower the color temperature is shown in FIG. 2 wherein color temperature in degrees Kelvin is plotted against the molar ratio of cadmium to scandium triiodide. The data used in constructing FIG. 2 depends on relative densities of lamp fill and not on the specific shape or geometry of the arc tubes. The data includes three bulb sizes, four different metal halide dose amounts, six different Hg doses, and three different Hg/Cd amalgam concentrations. It will be observed that a $Cd/ScI_3$ molar ratio of about 0.5 will result in a color temperature of 2900° K. corresponding approximately to that of an incandescent lamp. The effect on color temperature is not prevented by the presence of thorium in lamps of the foregoing kind. However the amount of thorium must be limited in order to avoid electrode distortion. The small amount of thorium that may be introduced into the lamp atmosphere incidentally to the use of thoriated tungsten wire for the electrodes is acceptable.

Figure 3:
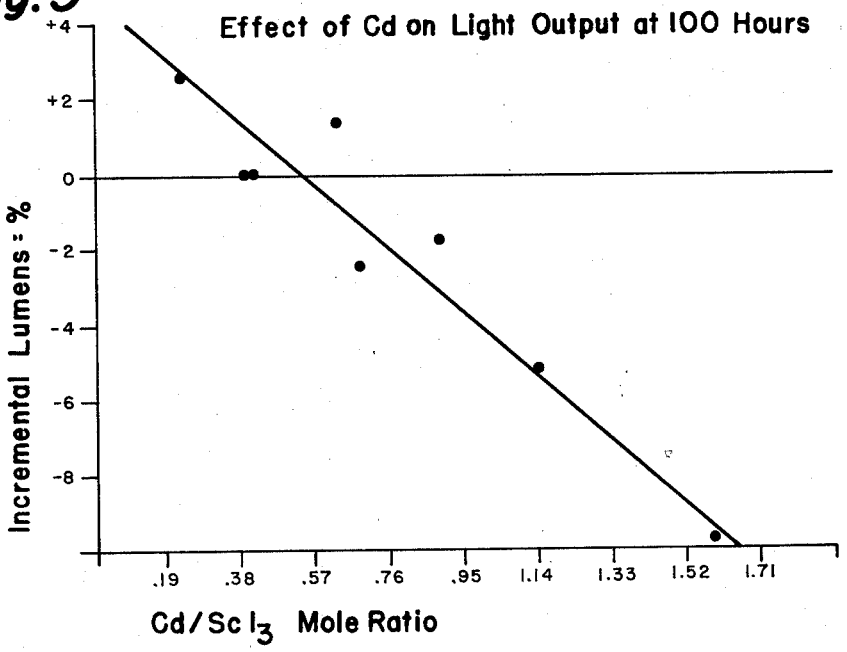
FIG. 3 is a graph showing the effect of cadmium addition on light output.

The beneficial effect of cadmium on color temperature entails some loss in efficiency. FIG. 3 shows the incremental percentage change in lumens resulting from the addition of cadmium to the arc tube. The incremental percentage change in lumens $\Delta\%L$ may be defined as follows:

$$\Delta\% L = \frac{\text{Lumens with Cd} - \text{Lumens without Cd}}{\text{Lumens without Cd}} \times 100$$

It will be noted that as the $Cd/ScI_3$ ratio increases, the lumen level decreases with respect to that in similar arc tubes made without cadmium. This is one limiting factor on the amount of Cd that can usefully be added.

Figure 4:
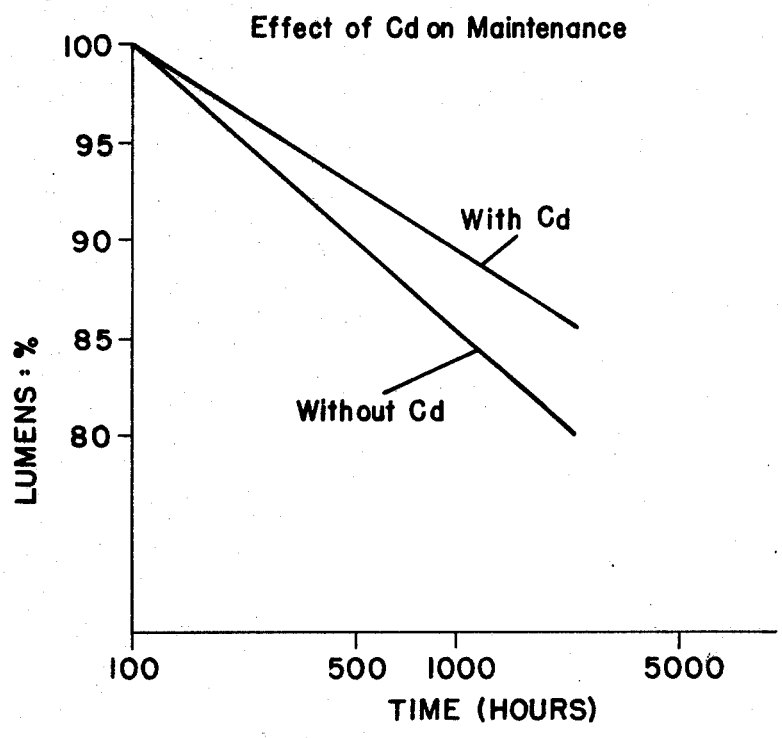
FIG. 4 is a graph showing the effect of cadmium addition on lumen maintenance.

The improved maintenance deriving from the addition of cadmium to the dose is apparent upon considering FIGS. 3 and 4 together. Referring to FIG. 3, it is observed that the lumen loss measured at 100 hours is 0 for a $Cd/ScI_3$ ratio of about 0.5. Referring to FIG. 4, that point is used as a common origin for the two curves with and without cadmium. It is seen that cadmium provides a real improvement in maintenance with growing divergence throughout life. By way of example, the increment in lumens with Cd is better than 5% at 2000 hours relative to a lamp without it.

Only a limited range of color temperatures is of interest in general lighting service. In particular, color temperatures below about 2400 K. have little commercial value and the $Cd/ScI_3$ ratio needed to achieve it is approximately 1. At this ratio, the incremental lumen loss at 100 hours is about 5% as seen in FIG. 3. Therefore these two factors determine an upper useful limit of about 1.0 for the mole ratio of Cd to $ScI_3$ in lamps according to our invention.

A lower useful limit for the addition of cadmium is determined by color variations resulting from chemical reaction processes and processing factors acting on the halide dose. We have found that a minimum of 0.04 mole Cd/mole $ScI_3$ is necessary to avoid these problems.

The serendipitous simultaneous lowering in color temperature and improvement in maintenance achieved by our invention is probably explainable as follows. The addition of Cd to a lamp containing $ScI_3$ will result in the formation of $CdI_2$ and Sc by the reaction:

$$(3/2)Cd(g) + ScI_3(g) \rightleftharpoons (3/2)CdI_2(g) + Sc(g) \quad (1)$$

wherein (g) indicates gaseous state. The equilibrium expression for reaction (1) is $$K_{eq} = \frac{(P_{CdI_2})^{3/2}(P_{Sc})}{(P_{Cd})^{3/2}(P_{ScI_3})}, \quad (2)$$

wherein P represents the pressure of the component, suitably measured in atmospheres. There is an analogous set of equations for a Zn addition.

At 1100 K., which is approximately the operating wall temperature for a miniature metal halide arc tube, the value of the equilibrium constant $K_{eq}$ is $1.3\times10^{-9}$ for the Cd system and $3.8\times10^{-8}$ for the Zn system.

As scandium is formed by reaction (1) it precipitates onto the arc tube walls since the vapor pressure of Sc at 1100 K. is only $2\times10^{-11}$ atm.

For the miniature arc tube of 32 watts rating illustrated in FIG. 1, the typical initial dose amounts of NaI, $ScI_3$, and Cd are:

NaI $=3.48\times10^{-3}$ gm or $2.32\times10^{-5}$ moles $ScI_3=0.52\times10^{-3}$ gm or $1.22\times10^{-6}$ moles Cd $=5.65\times10^{-5}$ gm or $5.03\times10^{-7}$ moles If all of the Cd were converted to $CdI_2$ the resulting loss of $ScI_3$ would not be sufficient to lower the pressure of $ScI_3$ below the vapor pressure of pure $ScI_3$ in the pool.

Since the values to use for $P_{Sc}$ and $P_{ScI3}$ in equation (2) are known, the amount of $CdI_2$ that will be formed may be calculated. For the typical miniature arc tube mentioned above, the amount of $CdI_2$ formed is about $4.38\times10^{-7}$ moles of $ScI_3$. The initial and final amounts of the reactive species are listed in Table I below.

TABLE I

| | Initial Dose | At 1100 K. |
|---|---|---|
| NaI | $2.32\times10^{-5}$moles | $2.32\times10^{-5}$moles |
| $ScI_3$ | $1.22\times10^{-6}$moles | $9.5\times10^{7}$moles |
| Cd | $5.03\times10^{-7}$moles | $0.9\times10^{-7}$moles |
| $CdI_2$ | 0 | $4.4\times10^{-7}$moles |
| NaI/$ScI_3$ | 19.0 | 24.4 |
| $P_{Sc}$ | 0 | $2.0\times10^{-11}$atm |

Consideration of the concentrations disclosed in Table I above leads to the following conclusions.

1. The addition of Cd to an arc tube containing NaI and $ScI_3$ causes the effective ratio of NaI to $ScI_3$ to increase from 19.0 to 24.4 resulting in a shift to lower (warmer) color temperatures without increasing wall temperatures.
2. There is still elemental Cd remaining in the gas phase after the chemical reaction given in equation (1) has reached steady state. The excess Cd reduces the level of free iodine near the silica walls by the formation of cadmium iodide, and inhibits the transport of silicon iodide to the electrodes.

Thus the practical improvements in the form of lower color temperature and improved maintenance achieved by our invention, while unexpected and fortuitous, have a sound basis in physical chemistry.

What we claim as new and desire to secure by Letters Patent of the United States is:

1. A miniature high intensity metal halide arc discharge lamp comprising an envelope of fused silica, defining a volume not exceeding 1 cubic centimeter, inleads sealed into said envelope and electrically connected to spaced tungsten electrodes positioned to define an arc gap therein not exceeding 1 centimeter, a discharge sustaining filling in said envelope-comprising mercury, sodium iodide and scandium triiodide plus an inert starting gas, said envelope containing virtually no thorium except such as may be introduced through the use of thoriated tungsten for the electrodes, and cadmium or zinc in said envelope in a molar ratio relative to $ScI_3$ in the range of 0.04 to 1.0.

2. A lamp as in claim 1 wherein the NaI concentration is in the range of 0.005 to 0.05 gm/cc and the $ScI_3$ concentration is in the range of 0.0008 to 0.008 gm/cc.

3. A lamp as in claim 2 wherein the mercury concentration is in the range of 0.015 to 0.05 gms/cc.

4. A lamp as in claim 3 wherein the molar ratio of Cd or Zn relative to $ScI_3$ is approximately 0.5.

* * * * *